United States Patent [19]

Diller

[11] Patent Number: 4,650,081

[45] Date of Patent: Mar. 17, 1987

[54] CLAW COUPLING FOR ELECTRIC TOY AND MODEL TRAINS

[75] Inventor: Hans Diller, Heroldsberg, Fed. Rep. of Germany

[73] Assignee: Gebr. Fleischmann, Nuremberg, Fed. Rep. of Germany

[21] Appl. No.: 805,489

[22] Filed: Dec. 5, 1985

[30] Foreign Application Priority Data

Dec. 20, 1984 [DE] Fed. Rep. of Germany ..... 3446457

[51] Int. Cl.[4] ..... B61G 1/00

[52] U.S. Cl. ..... 213/75 TC; 105/1.5; 104/DIG. 1

[58] Field of Search ..... 104/DIG. 1; 213/211, 213/75 TC, 153, 155; 105/1 T

[56] References Cited

U.S. PATENT DOCUMENTS

| | | | |
|---|---|---|---|
| 2,631,740 | 3/1953 | Watson | 213/75 TC |
| 3,564,766 | 3/1969 | Edwards et al. | 213/75 TC |
| 3,662,489 | 5/1972 | Terrier | 213/75 TC |
| 3,739,989 | 2/1974 | Thomson | 213/75 TC |
| 3,831,776 | 8/1974 | Antonik | 213/75 TC |

FOREIGN PATENT DOCUMENTS

| | | | |
|---|---|---|---|
| 629760 | 3/1963 | Belgium | 213/75 TC |
| 1039432 | 11/1955 | Fed. Rep. of Germany | 213/75 TC |

*Primary Examiner*—Robert B. Reeves
*Assistant Examiner*—Glenn B. Foster
*Attorney, Agent, or Firm*—Jordan and Hamburg

[57] ABSTRACT

A claw coupling for electric toy and model trains with prerelease has a claw, which can be hooked from the side into a rigid hook of the respective end supporting part, and which is spring-mounted and preclamped so that it can swivel in a horizontal plane into the coupling position and can be lifted upwardly by means of a coupling lever of a release track and which engages a pivot journal that projects downwardly. The pivot journal is mounted in a borehole acting against a vertical restoring force from its coupling position into a release position that is limited by a stop. The spring, which produces the restoring force that counteracts the swivelling motion, is in the form of a tongue adjacent to the claw, optionally with clearance, and is attached to a bearing part. A downwardly directed bearing leg, the length of which corresponds at least to the ejection height, is attached to the outerside of the claw, and the bearing leg is provided with an outwardly facing intercepting projection which, in the open position of the claw, underlies the tongue in such a manner that an accidental ejection due to vibrational shocks or the like is prevented. The upper side of the intercepting projection, facing the tongue, is formed as an inclined plane that slopes towards the outside.

10 Claims, 4 Drawing Figures

CLAW COUPLING FOR ELECTRIC TOY AND MODEL TRAINS

BACKGROUND OF THE INVENTION

This invention relates to a claw coupling for electric toy and model trains with prerelease and having a claw which can be hooked from the side into a rigid hook of the respective end support part. The claw is spring-mounted and preclamped so that it can swivel in a horizontal plane into a coupling position and can be lifted upwards by means of a coupling lever of a release track, which engages a pivot journal that projects downwardly and is mounted in a borehole, against a vertical restoring force from its coupling position to a release position that is limited by a stop.

Such an arrangement, which has also become known as a so-called Fox coupling and is described in the German Offenlegungsschrift No. 2,041,361, enables short couplings to be constructed which, aside from coupling and release, makes a prerelease possible at the same time by means of a release track in such a manner that the railroad cars, with raised claws, can be pushed and shunted to any position on the tracks and that recoupling is possible only after the power-propelled vehicles have moved off.

The difficulty with the Fox coupling heads is that the spring, which produces the restoring force that counteracts the swivelling motion, is constructed as a torsion spring that surrounds the pivot journal and is supported at its lower side by a thickened head and at the same time produces the vertical restoring force. The manufacture of the parts and especially the assembly of the very small components, especially of the small, helical pressure spring, create considerable difficulties in practice.

It is therefore an object of the invention to provide a claw coupling of the initially mentioned type which consists of a few, easily-manufactured and, especially, easily-assembled components, so that such a coupling is still meaningfully realizable also in models of the smallest sizes having the narrowest gauges.

To accomplish this objective, provisions are made inventively so that the spring, which produces the restoring force that counteracts the swivelling motion, is a tongue, adjacent to the claw, optionally with clearance, and attached to the bearing part so that a bearing leg is provided with an outwardly facing intercepting projection which, in the one position of the claw, underlies the tongue in such a manner that an accidental ejection due to vibrational shocks or the like is prevented. The upper side of the intercepting projection, facing the tongue, is constructed as an inclined plane that slopes towards the outside.

Due to the force that the spring, which produces the restoring force that counteracts the swivelling motion, is constructed as a spring which produces the restoring force that counteracts the swivelling motion, a construction, which in itself is known from the German Offenlegungsschrift, there no longer is the problem of installing a small helical pressure spring, a problem which has made the use of the Fox coupling exceedingly difficult, especially in the case of narrow gauges. In order to let this spring, which produces the restoring force that counteracts the swivelling motion and which is constructed as a simple, attached tongue, to become effective also independently of the respective coupling or release position, a bearing leg is provided at the outer side of the claw with an intercepting projection. The intercepting projection is provided in addition to the already-discussed stop which prevents the complete going astray of the coupling part. The intercepting portion prevents accidental release due to vibrational shocks. Because of the special tongue construction of the restoring spring, accidental release due to vibrational shocks cannot be prevented by the restoring spring, at least not to the same extent as with the helical pressure spring of the Fox coupling. However, the construction of the upper side of the intercepting projection as an inclined plane sloping towards the outside prevents the ascent due to vibrational shocks, since the forces which occur are not sufficient to spread apart the spring, which produces the restoring force that counteracts the swivelling motion over the inclined plane towards the outside. However, the coupling lever of the release track produces a much larger force so that the intended release is not impeded by this intercepting projection.

In the development of the invention, it has proven to be particularly simple and appropriate to use gravity as the vertical restoring force, as has already been proposed in U.S. Pat. No. 2,7388,080 for a claw coupling which, in other respects, is constructed differently.

Finally, it also falls within the scope of the invention to construct the tongue as a bar spring and to arrange it in such a manner that, in addition to the restoring force that counteracts the swivelling motion, it also supplies the vertical restoring force.

The invention will be described in greater detail below by an example of the operation, as well as by means of the drawings.

DESCRIPTION OF THE PREFERRED EMBODIMENTS

Figure 1:
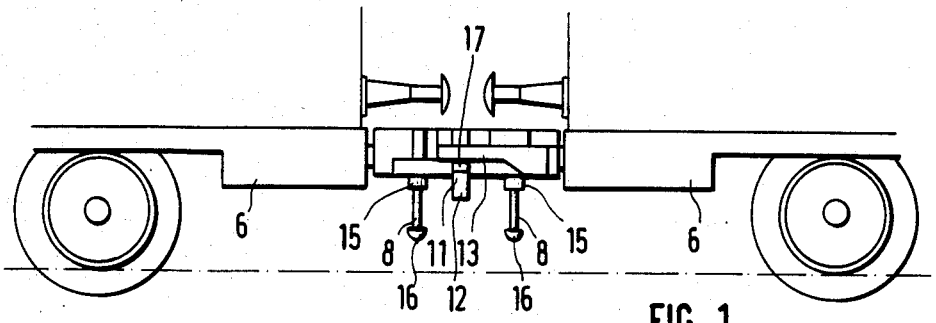
FIG. 1 is a partial side view of two model railroad cars linked together with claw couplings according to the present invention.
Figure 2:
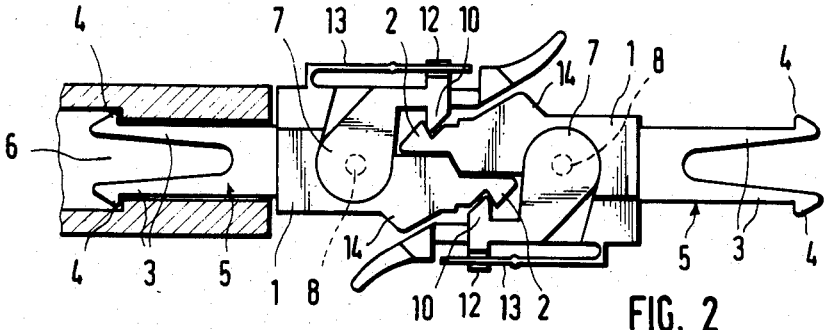
FIG. 2 is an enlarged plan view of two coupled coupling heads.
Figure 3:
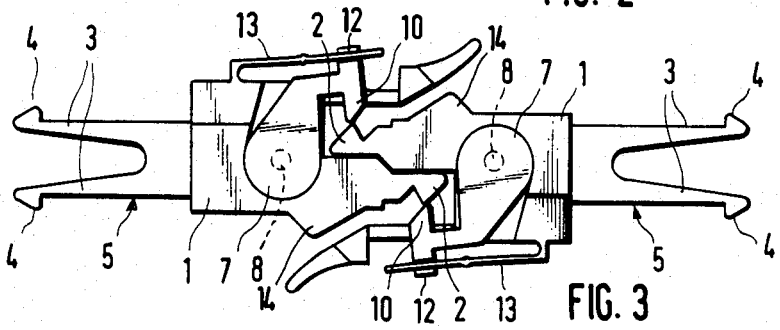
FIG. 3 is a plan view, corresponding to FIG. 2, but showing the parts during the coupling process.
Figure 4:
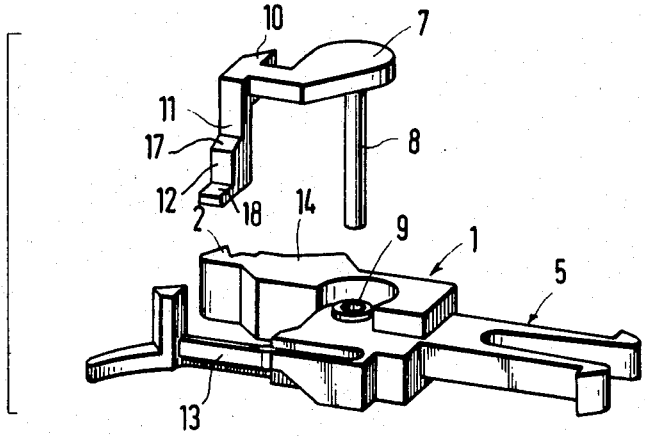
FIG. 4 is a perspective exploded view of the coupling head.

Each coupling head comprises a bearing part 1 with a rigid, outwardly pointing hook 2 at the front end and a plug connection 5 comprising two spring legs 3 with outwardly directed hooks 4 for inserting into standardized receiving shafts in accordance with the European Model Train Standard NEM 362. A claw 7 is supported on the bearing part 1 and engages a borehole 9 with its pivot journal 8. In the region of the head 10 of the hook, there is a bearing leg 11 which is directed downwardly and to which there is attached an outwardly facing intercepting projection 12 adjacent to which there is a leaf-spring-like tongue 13 which is attached to the side of the bearing part 1. The bearing leg 11 ensures that, in spite of vertical displacement of the claw 7 that is necessary for release so that the claw 7 can be raised above the surface 14 of the bearing part 1, the leaf spring 13 constantly retains its connection with the claw and therefore can force it inwardly into its coupling position. The going astray of claw 7 is prevented owing to the fact that a thickening 16, which strikes against a sleeve 15 is the raised position of claw 7, is attached to the end of the pivot journal 8 after the assembly or joining process. The sleeves 15 are attached to the underside of the bearing part 1 and form a continuation of the bearing borehole 9 for the pivot journal 8.

In order to prevent the claw 7, which is held down in its coupling position only by the action of gravity, from rising up during vibrational motions, such as those which occur in play operation when crossing rail joints or the like, there is provided at the outer side of the bearing leg 11 the outwardly facing intercepting projection 12, whose upper side, facing the leaf spring 13, is constructed with an inclined plane 17 that slopes towards the outside. In spite of its formation as an inclined plane 17, the upper side of the intercepting projection 12 prevents the claw 7 from rising under the influence of the slight forces which occur during vibrational motion since this inclined plane is crossed by the tongue 12 and the ascent is effectively prevented therewith. However, the coupling lever that engages the pivot journal 8 can lift the claw 7 upwardly without any problems, the tongue 13 then being swung aside, towards the outside in a sliding motion on the inclined plane 17. Instead of the stop 16, an additional, outwardly facing projection 18, at the lowest end of the intercepting projection 12, could also form the stop that prevents the going stray of claw 7.

What I claim is:

1. A coupling for toy trains comprising a bearing part attachable to a toy train, said bearing part having a hook claw means pivotably mounted on said bearing part and pivotable in a coupling direction and an opposite decoupling direction, said claw means having a claw part which is operable to engage the hook on a like bearing part attached to another toy train to effect a coupling between two toy trains, said bearing part having a tongue which extends from the bearing part, said claw means having a downwardly depending leg which is juxtaposed to said tongue such as to biasingly oppose pivoting of said claw means in said decoupling direction, said downwardly depending leg having a projecting part underlying said tongue so as to provide for biasingly resisting upward vertical movement of said claw means relative to said bearing part.

2. A coupling according to claim 1, wherein said tongue is in the form of a leaf spring having one end integrally joined to said bearing part.

3. A coupling according to claim 1, wherein said claw means generally overlies said bearing part such that the weight of said claw means disposes said claw means in its assembled and operable position.

4. A coupling according to claim 1, wherein said claw means has a back part opposite to said claw part, said downwardly depending leg of said claw means having a back section which is a planar continuation of said back part of said claw means, said back section being juxtaposed to said tongue to biasingly resist pivotal movement of said claw means in said decoupling direction.

5. A coupling according to claim 1, wherein said downwardly depending leg has a lower terminating end portion, said projection part being located at said terminating end portions.

6. A coupling according to claim 4, wherein said projecting part projects from said back section.

7. A coupling according to claim 4, wherein said projecting part has a sloping upper surface sloping to the general plane of said back section.

8. A coupling according to claim 1, wherein said claw means has a pivotal pin which extends through an opening in said beaing part so that a portion of said pin extends beneath said bearing part, and enlargement means on an end portion of said pin for preventing withdrawing of said pin through said opening.

9. A coupling according to claim 8, wherein said bearing part has a vertical thickness less than the longitudinal length of said pin to permit said claw means to be raised vertically relative to said bearing part.

10. A coupling according to claim 1, wherein said projecting part has enlargement means for preventing lifting off of said claw means from said bearing part.

* * * * *